US007563136B1

(12) United States Patent
Wu

(10) Patent No.: US 7,563,136 B1
(45) Date of Patent: Jul. 21, 2009

(54) CABLE ASSEMBLY HAVING INTERIOR SHIELDING STRUCTURE FOR SUPPRESSING ELECTRO-MAGNETIC INTERFERENCE

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/215,119

(22) Filed: Jun. 24, 2008

(51) Int. Cl.
*H01R 9/03* (2006.01)

(52) U.S. Cl. ..... 439/610; 439/460; 439/581

(58) Field of Classification Search ..... 439/607, 439/449, 460, 610, 76.1, 83, 92, 581, 493, 439/497

See application file for complete search history.

(56) References Cited

U.S. PATENT DOCUMENTS

| | | | | |
|---|---|---|---|---|
| 6,431,901 | B1 | 8/2002 | Yeh | |
| 6,716,057 | B1 * | 4/2004 | Wu | 439/497 |
| 6,866,539 | B2 | 3/2005 | Chang | |
| 7,223,915 | B2 | 5/2007 | Hackman | |

* cited by examiner

*Primary Examiner*—Javaid Nasri
(74) *Attorney, Agent, or Firm*—Wei Te Chung

(57) ABSTRACT

A cable assembly includes a connector (1) having an insulated housing (100) and a plurality of contacts (10) received therein; a printed circuit board (2) having a front portion and an opposite rear portion, with the front portion thereof connected to the connector; a cable (4) coupled to the rear portion of the printed circuit board; a metallic shell (71, 72) enclosing the printed circuit board and a rear portion of the connector; a cover (8) enclosing the metallic shell. A metallic braiding portion of the cable are electrically connected to the metallic shell and a grounding pad of the printed circuit board.

10 Claims, 9 Drawing Sheets

CABLE ASSEMBLY HAVING INTERIOR SHIELDING STRUCTURE FOR SUPPRESSING ELECTRO-MAGNETIC INTERFERENCE

CROSS-REFERENCE TO RELATED APPLICATION

This application Ser. No. 12/215,126, filed Jun. 24, 2008, is related to U.S. patent application entitled "Cable Assembly Having Interior Shielding Structure for Suppressing Electromagnetic Interference", and it has the same applicant and assignee as the present invention. The disclosure of the related application is incorporated herein by reference.

FIELD OF THE INVENTION

The present invention generally relates to a cable assembly, and more particularly to a connector thereof having an internal shielding structure for suppressing electromagnetic interference.

DESCRIPTION OF PRIOR ART

Electromagnetic interference (or EMI, also called radio frequency interference or RFI) is a (usually undesirable) disturbance that affects an electrical circuit due to electromagnetic radiation emitted from an external source. The disturbance may interrupt, obstruct, or otherwise degrade or limit the effective performance of the circuit. The source may be any object, artificial or natural, that carries rapidly changing electrical currents, such as an electrical circuit, the Sun or the Northern Lights.

EMI can be induced intentionally for radio jamming, as in some forms of electronic warfare, or unintentionally, as a result of spurious emissions and responses, intermodulation products, and the like. It frequently affects the reception of AM radio in urban areas, cell phone, FM radio and television reception. It can also a data transmitting line between two electronic devices, such as a cable assembly.

A cable assembly, especially utilized for high-speed signal transmitting, has some precautions against EMI. Serial ATA connector assembly, which is widely used in recent years, equipped with anti-EMI structures in both cables and a connector. For example, U.S. Pat. No. 6,866,539 issued to Chang on Mar. 15, 2005 discloses a high frequency connector used for connecting with a high frequency transmission cable as to offer a function of transmitting signal of an electric appliance. The high frequency connector includes an insulation body with multiple terminal therein, a metal inner covering disposed at outer side of the insulation body and a jacket disposed at the outermost side of the connector. The terminals are electrically connected to the cable and the inner cover at an end thereof has a locating device for holding the cable.

A cable assembly has a different structure for anti-EMI and manufactured easily is required.

SUMMARY OF THE INVENTION

Accordingly, an object of the present invention is to provide an anti-EMI cable assembly.

In order to achieve the object set forth, a cable assembly in accordance with the present invention comprises a connector having an insulated housing and a plurality of contacts received therein; a printed circuit board having a front portion and an opposite rear portion, with the front portion thereof connected to the connector; a cable coupled to the rear portion of the printed circuit board; a metallic shell enclosing the printed circuit board and a rear portion of the connector;

a cover enclosing the metallic shell. A metallic braiding portion of the cable are electrically connected to the metallic shell and a grounding pad of the printed circuit board.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Figure 1:
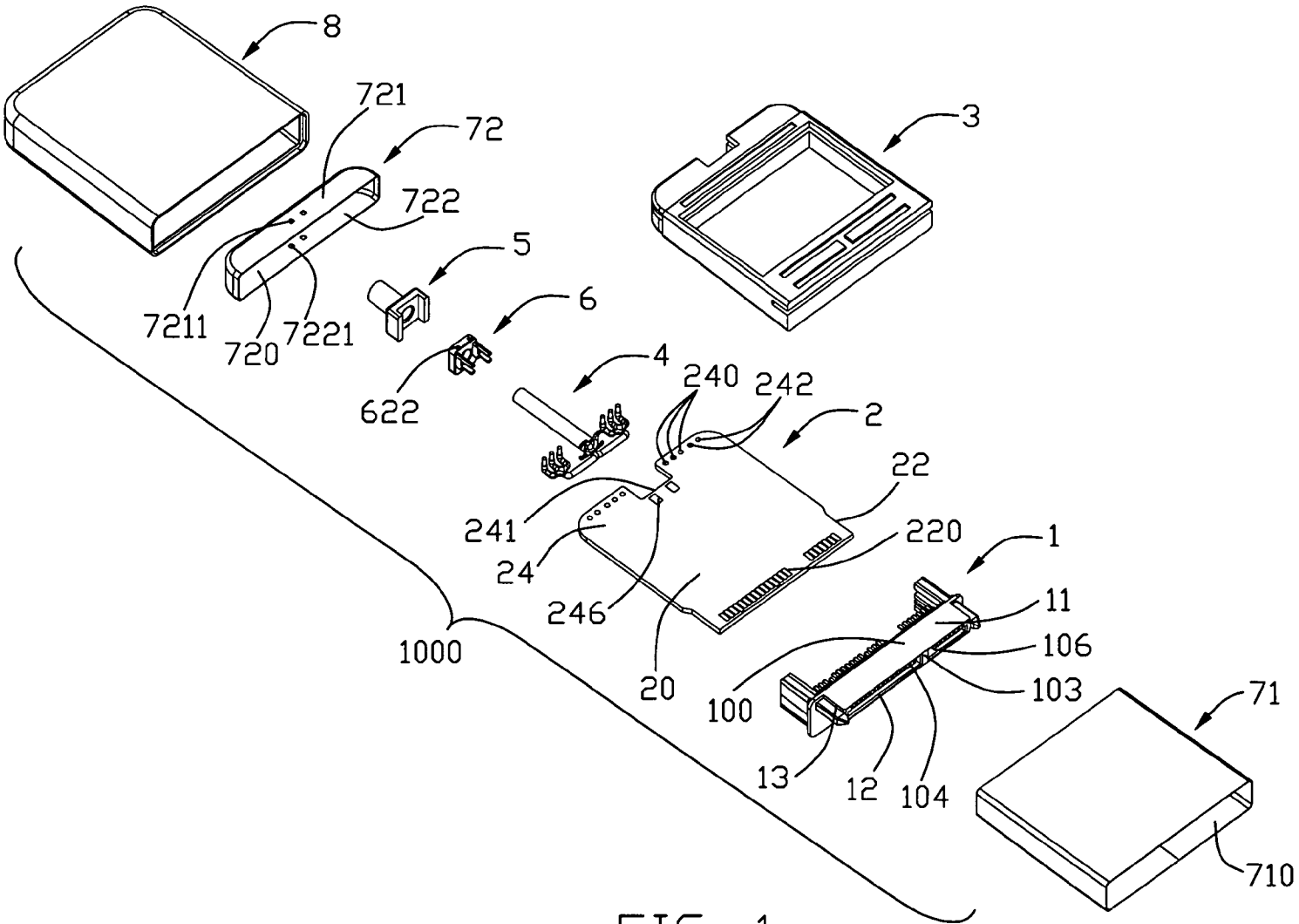
FIG. 1 is an exploded, perspective view of a first connector assembly.
Figure 2:
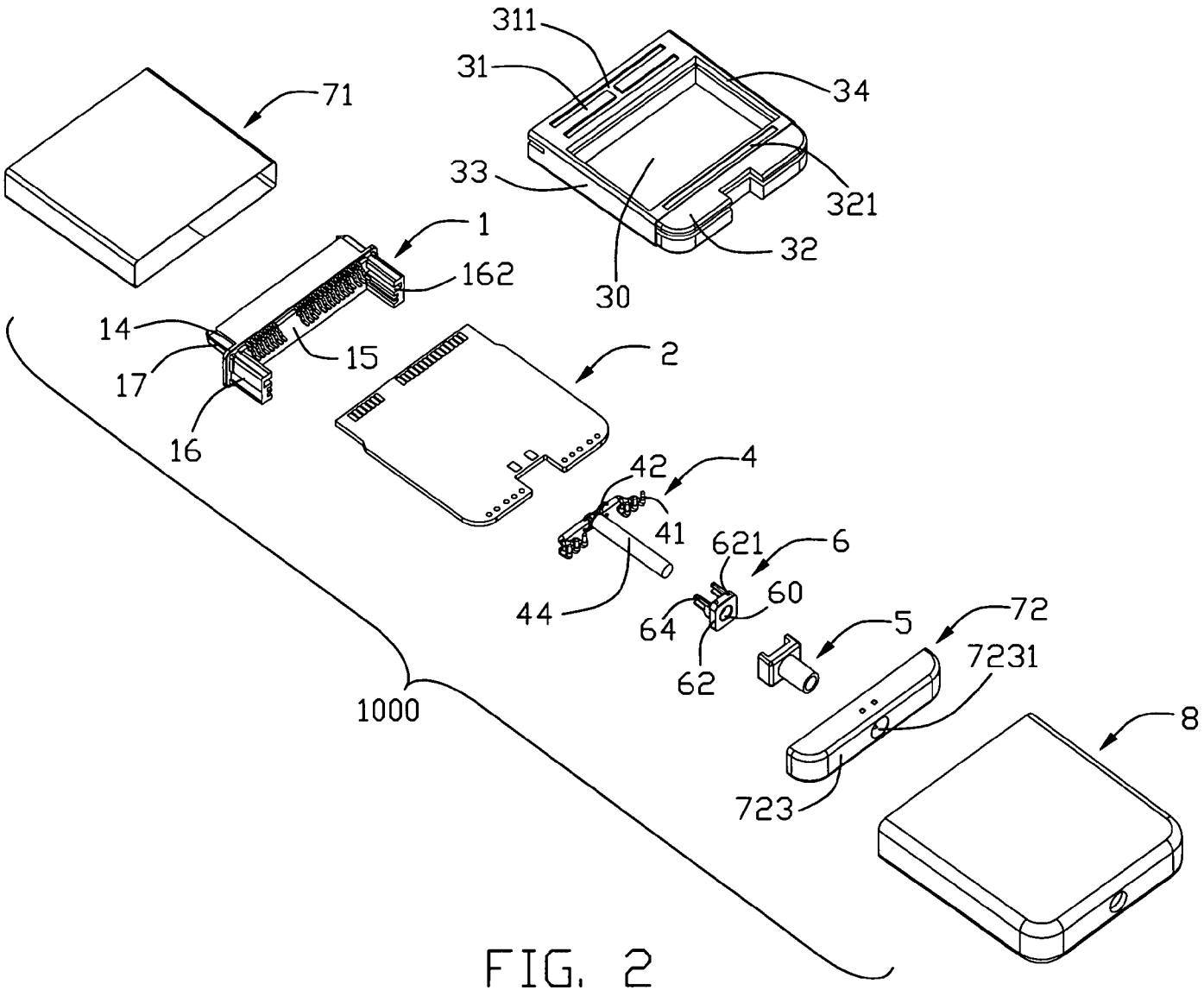
FIG. 2 is similar to FIG. 1, but viewed from another aspect.
Figure 3:
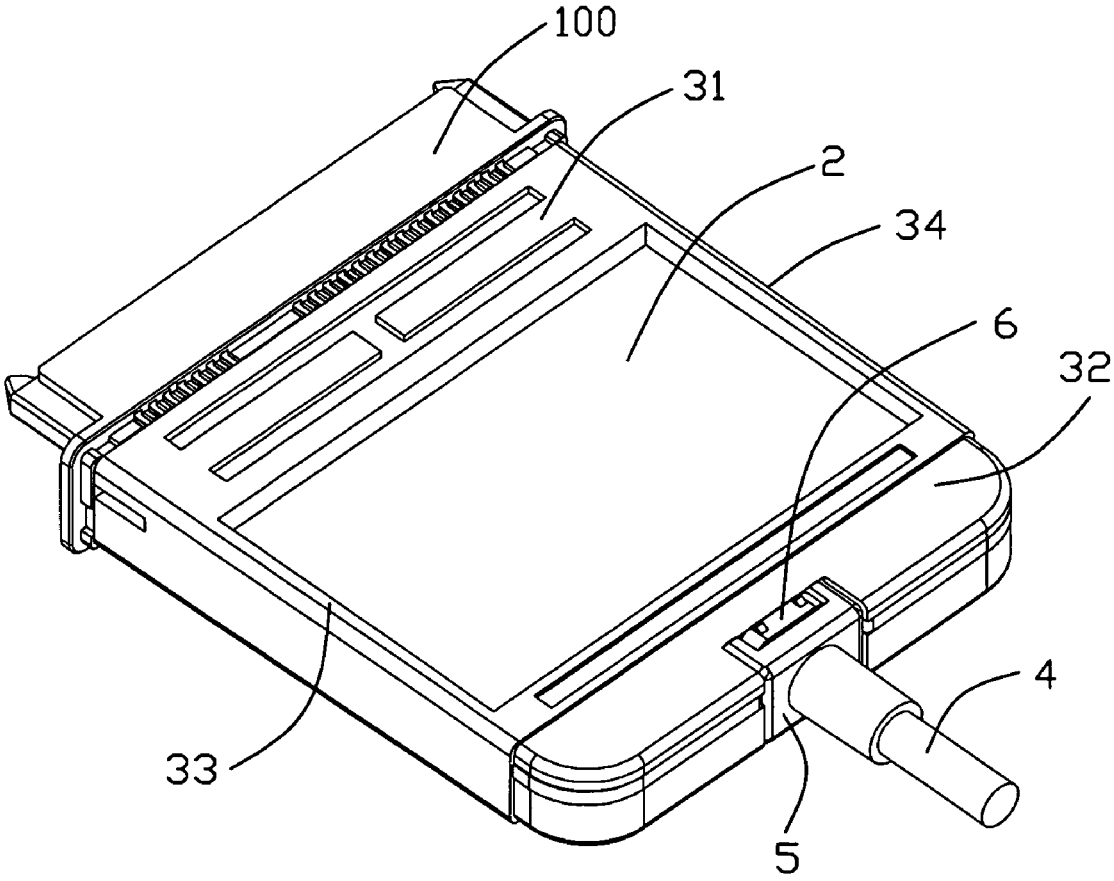
FIG. 3 is a partially assemble view of the first connector assembly.
Figure 4:
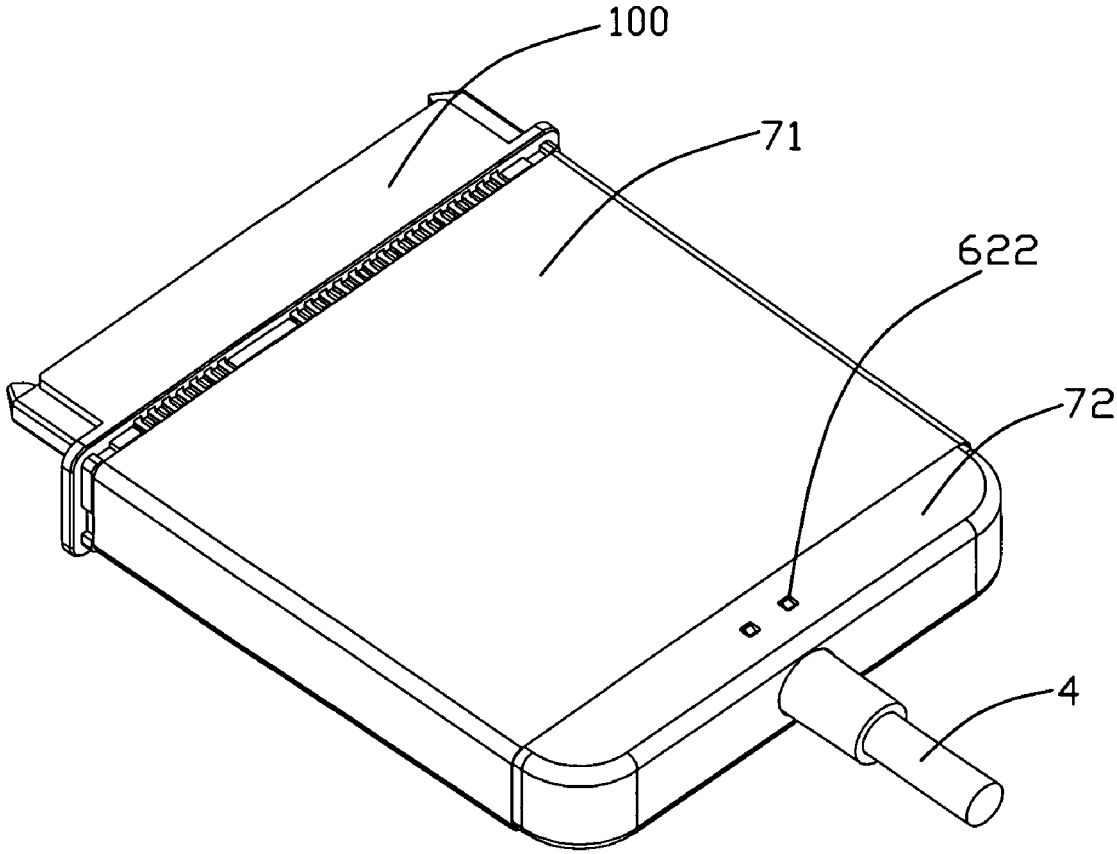
FIG. 4 is another partially assemble view of the first connector assembly.
Figure 5:
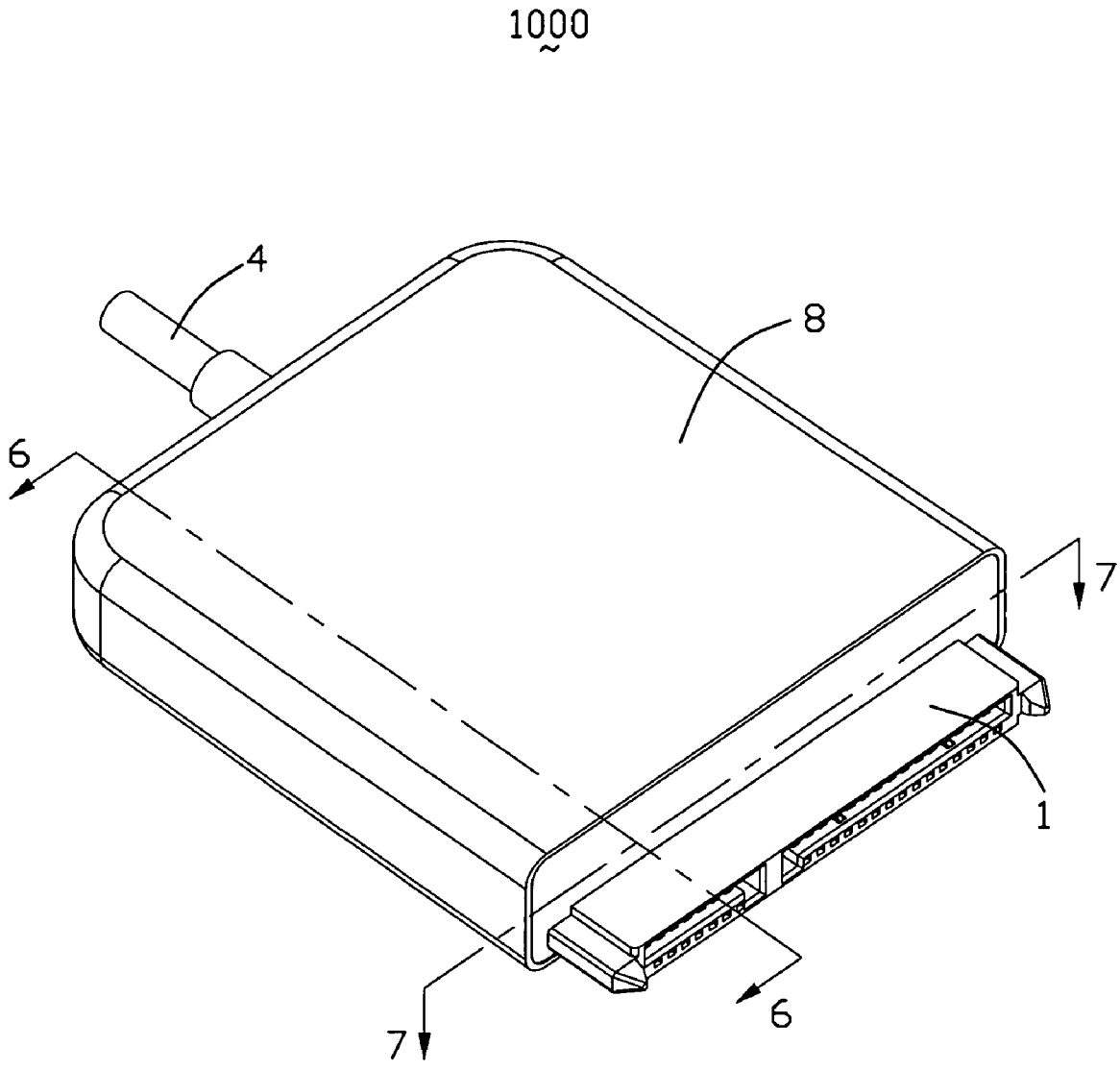
FIG. 5 is an assembled, perspective view of the first connector assembly.
Figure 6:
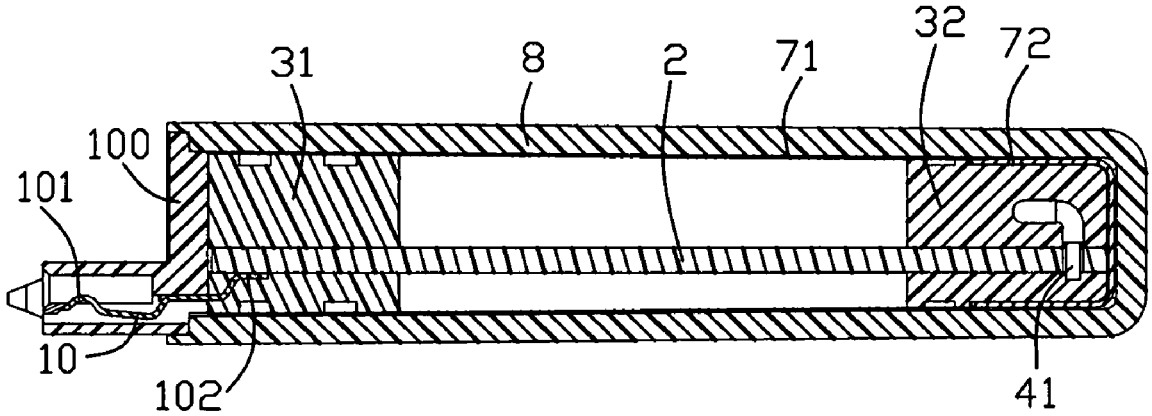
FIG. 6 is a cross-section view taken along line 6-6 of the FIG. 5.
Figure 7:
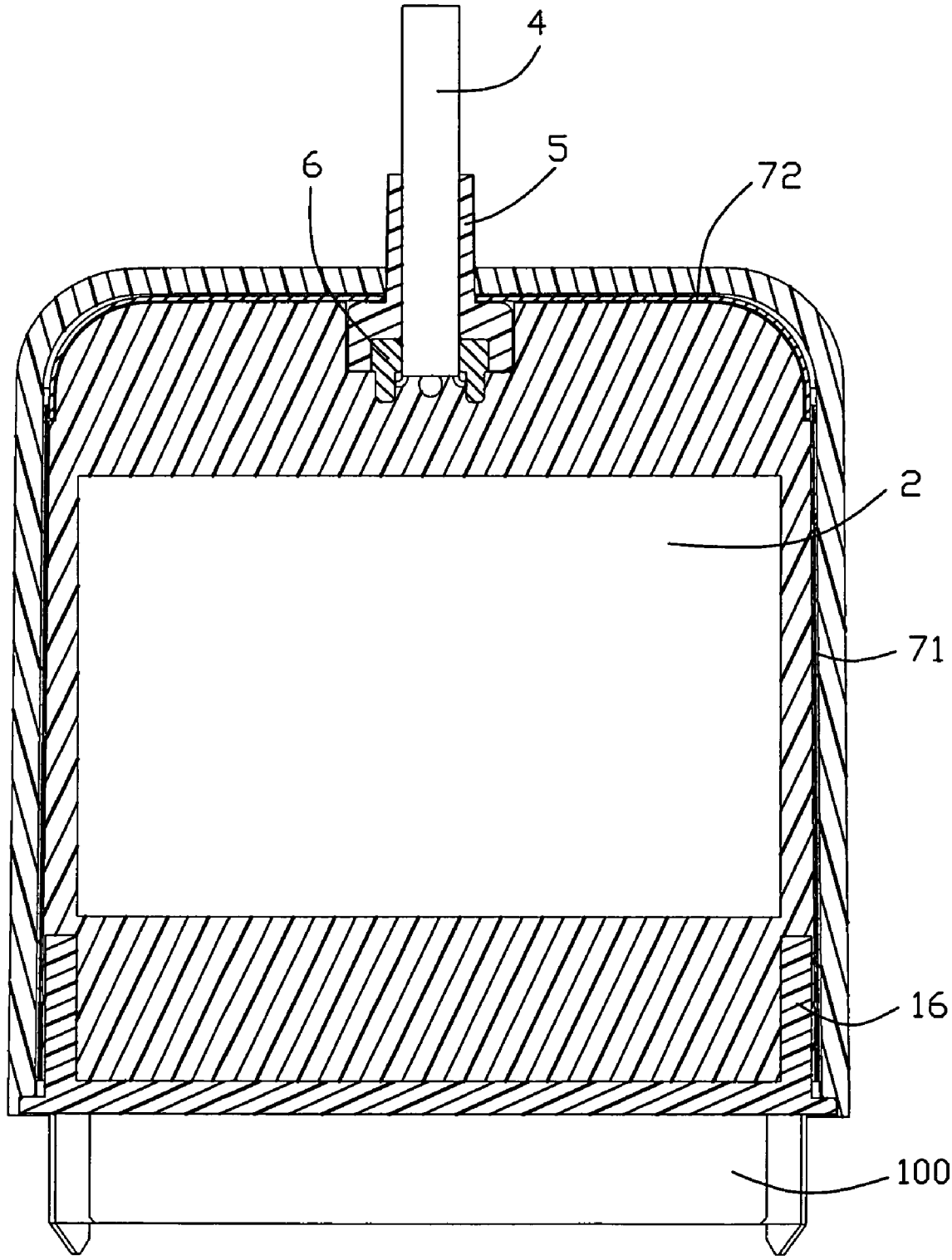
FIG. 7 is a cross-section view taken along line 7-7 of the FIG. 5.
Figure 8:
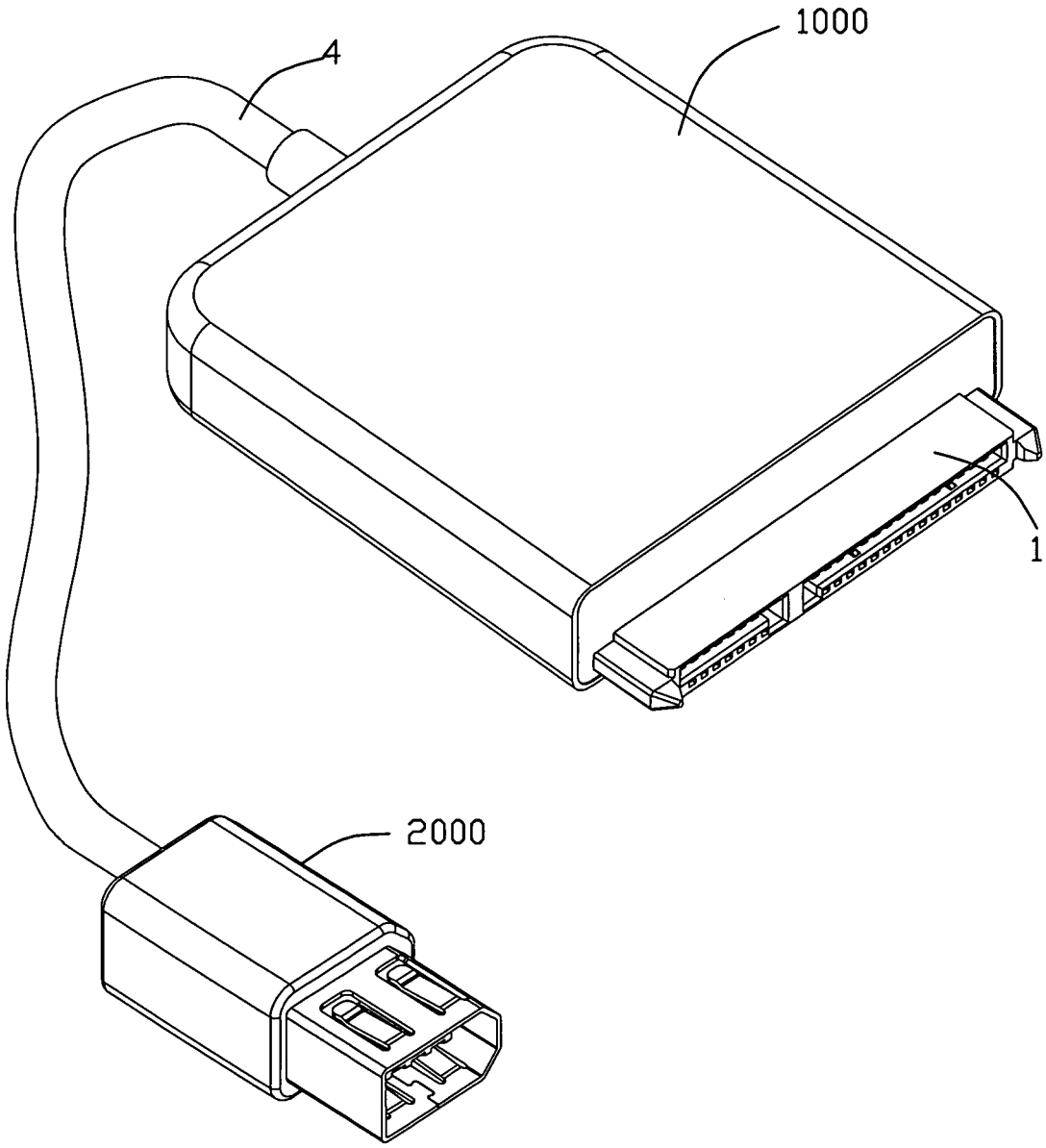
FIG. 8 shows the first connector assembly interconnects with a second connector of a cable assembly in accordance with the present invention.
Figure 9:
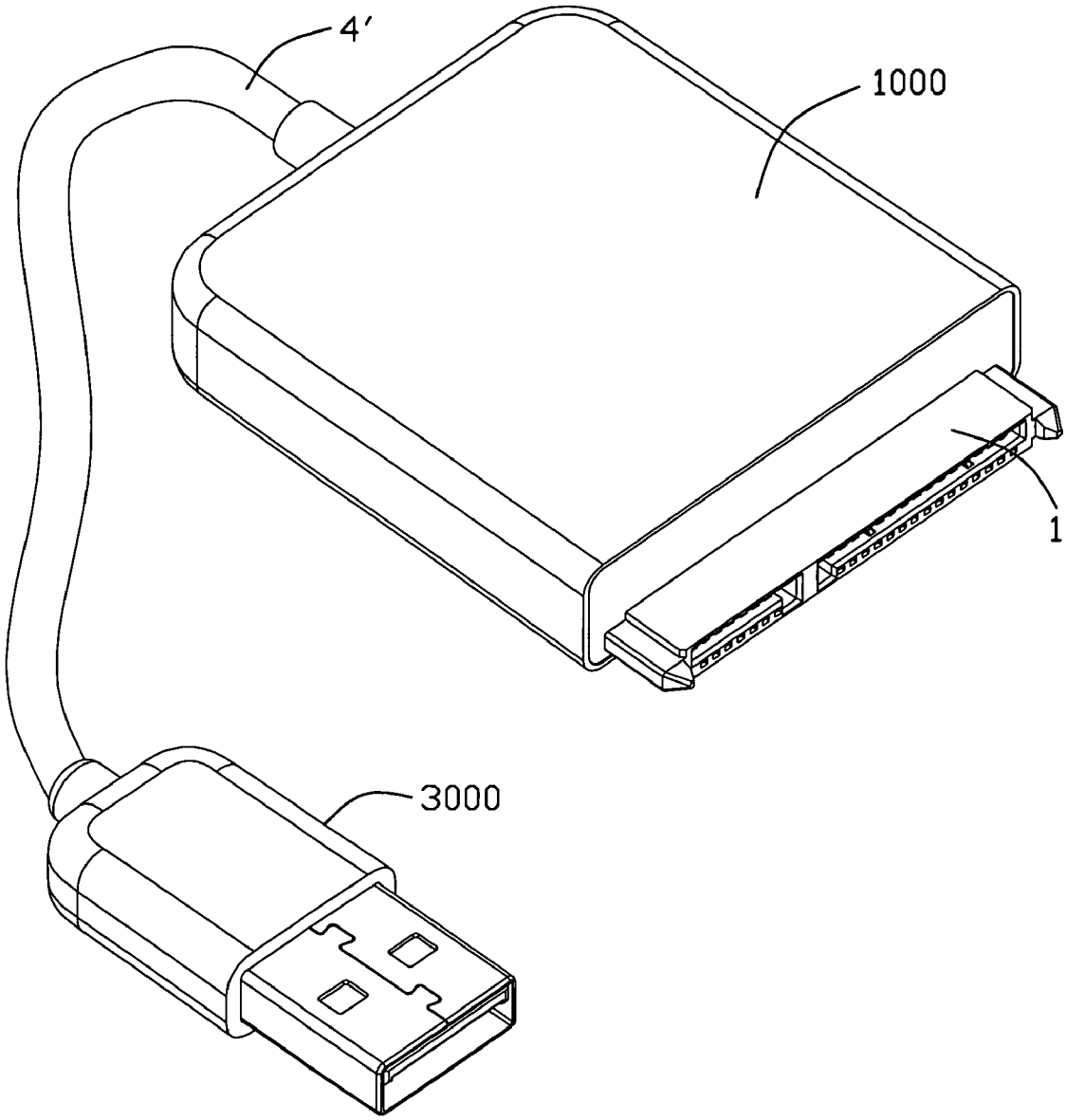
FIG. 9 shows the first connector assembly interconnects with a third connector of a cable assembly in accordance with the present invention.

Referring to FIGS. 8-9, a cable assembly in accordance with the present invention comprises a first connector assembly 1000 optionally interconnects with a second connector 2000 or third connector 3000. In the exemplary embodiment, the first connector assembly 1000 is adapted for Serial Advanced Technology Attachment (SATA) protocol, while the second connector 2000 adapted for IEEE 1394 protocol and the third connector 3000 is adapted for Universal Serial Bus (USB) protocol.

Referring to FIGS. 1-7, the first connector assembly 1000 comprises a first connector 1 with a number of contacts 10 received therein, a printed circuit board (PCB) 2, a framework 3, a cable 4, a strain relief member 5, a grounding member 6 and a cover 8. The first connector assembly 1000 further comprises a metallic shell (not numbered) shrouding the framework 3, and the shielding member including a sleeve member 71 and a cap member 72.

The first connector 1 has an elongated insulated housing 100 which has a top wall 11, a bottom wall 12 and a pair of side walls 13, 14 interconnected together to enclose a receiving space (not numbered) therebetween. The receiving space is divided into two chambers 104, 106 by a spacer 103. Both the chambers 104, 106 are L-shaped viewed from a front side. A flange portion 15 is attached to a rear edge of the insulated housing 100 and extends beyond a low surface of the bottom wall 12. A pair of arms 16 are integrated with the insulated housing 100 and extend rearward from lateral sides of a back portion of the flange portion 15. Each arm 16 has a groove 162 defined in a lower section of an inner side thereof. Furthermore, a pair of guiding posts 17 are disposed lateral sides of the insulated housing 100 and extend forwardly from front surface of the flange portion 15.

The PCB 2 includes a circuit substrate 20, with a set of conductive traces 220 arranged on a front portion 22 thereof, a cutout 241 in a rear portion 24 thereof, a plurality of first conductive holes 240 arranged on the rear portion 24 separated into two groups and symmetrically disposed aside of the cutout 24, and a number of second conductive holes 242 also arranged on the rear portion 24 and disposed outside of the first conductive holes 240. A group of grounding pads 246 is disposed on the rear portion 24, in front of the cutout 241.

The framework 3 comprises a first retainer 31, a second retainer 32 opposite to the first retainer 31 along a longitudinal direction, a pair of lateral arms 33, 34 connected to the first retainer 31 and second retainer 32, respectively. The first and second retainers 31, 32 and the pair of lateral arms 33, 34 corporately encircle a receiving space 30 thereamong. An upper and bottom portion of the first retainer 31 and second retainer 32 have first slots 311 and second slots 321, respectively.

The cable 4 includes a plurality of wires 41, a metallic braiding portion 42 enclosing the wires 41, and a jacket 44 shielding the metallic braiding portion 42. The metallic braiding portion 42 and the jacket 44 of a front portion of the cable 4 are removed away, with the wires 41 exposed outside and separated into two groups, and each group has three individual wires 41.

The grounding member 6 includes a body portion 62 with a passage 60 therein allowing the cable 4 through, a pair of fork-shaped leg portions 64 arranged lateral sides of the body portion 62. Two pair of tabs 621, 622 are respectively formed on a top and a bottom surface of the body portion 62. The body portion 62 grips the jacket 44 of the cable 4. The metallic braiding portion 42 of the cable 4 is soldered to the body portion 62, while the fork-shaped leg portions 64 clip the PCB 2 and are soldered to the group of grounding pads 246. The strain relief member 5 is molded over the body portion 62 of the grounding member 6 and the jacket 44 adjacent to the body portion 62.

The sleeve member 71 is about rectangular-shaped and made of copper, or other metal materials plated with copper. The sleeve member 71 encloses a hollow portion 710 with opposite front opening and rear outlet (not numbered). The cap member 72 including an upper wall 721, a bottom wall 722 and a vertical wall 723 joining to side and back margins (not numbered) of the upper and bottom walls 721, 722 to corporately form a receiving space 720 with a front opening (not numbered). Two pair of holes 7211, 7221 are located in the upper wall 721 and the bottom wall 722. The vertical wall 723 further defines an aperture 7231 in a back section thereof.

When assemble, the contacts 10 is inserted into the insulated housing 100 of the first connector 1, with mating portions 101 extending into the receiving space thereof, tail portions 102 disposed outside of a rear surface of the insulated housing 100. Then lateral sides of the front portion of the PCB 2 is inserted into the grooves 162 of the pair of arms 16 of the first connector 1, with the rear portions 102 of the contacts 10 disposed on the conductive traces 220 of the front portion 22 of PCB 2 and soldered thereon.

Secondly, after the grounding member 6 is crimped to the cable 4 and the strain relief member 5 is molded over thereon, then a front portion of the strain relief member 5 is disposed in the cutout 241 of the PCB 2. The wires 41 are bent downwardly, inserted into the first conductive holes 240 and soldered therein.

Thirdly, the framework 3 is molded over the first connector 1 and the PCB 2, with the pair of arms 16 and the front portion 22 of the PCB 2 enclosed in the first retainer 31; lateral sides of the PCB 2 wrapped in the arms 33, 34 of the framework 3; the rear portion of the PCB 2, partial of the strain relief member 5 and the grounding member 6 and wires 41 exposed outside enclosed in the second retainer 32.

Fourthly, glue (not shown) is poured the first slots 311 and second slots 321, then the sleeve member 71 is assembled to the framework 3, with the pair of arms 16, the first retainer 31 and a pair of lateral arms 33, 34 received in the hollow portion 710. Fifthly, the cap member 72 is assembled to the second retainer 32 of the framework 3 and contact a rear edge of the sleeve member 71, with the tabs 621, 622 snapped into the holes 7211, 7221 of the upper wall 721 and the bottom wall 722, the cable 4 extending outwardly through the aperture 7231 of the vertical wall 723. Sixthly, glue is applied to the sleeve member 71 and the cap member 72, and then the cover 8 is mounted to thereon. Seventhly, the cable 4 is coupled to the second connector 2000. Thus, a grounding line is formed between the sleeve member 71, the cap member 72, the cable 4, the PCB 2, by such arrangement, the cable assembly may acquire better anti-EMI effect.

FIG. 9 illustrates that the first connector assembly 1000 connects to the third connector 3000 via another cable 4'. The cable 4' is similar to the aforementioned cable 4, excepted that only four wires therein and respectively soldered to the second conductive holes 242, and other same structure is omitted hereby.

In the preferred embodiment, the first connector assembly 1000 is alternatively coupled to the second connector 2000 and the third connector 3000 by selecting different conductive pads of the PCB 2, however, more different conductive pads for more connectors is anticipated by the present invention. Furthermore, the PCB 2 can be connected to different connectors, optionally, which may be convenient for producers, and the cost of the production is decreased.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. A connector including an insulated housing and a plurality of contacts received therein; a printed circuit board having a front portion and an opposite rear portion, with the front portion thereof connected to the connector; a cable coupled to the rear portion of the printed circuit board; a metallic shell enclosing the printed circuit board and a rear portion of the connector; a cover enclosing the metallic shell; and wherein a metallic braiding portion of the cable are electrically connected to the metallic shell and a grounding pad of the printed circuit board, wherein a grounding member is attached to a front portion of the cable and proximate to the rear portion of the printed circuit board, contacting the grounding pad and the metallic shell simultaneously, wherein the grounding member has a body portion soldered to the metallic braiding portion of the cable and a leg portion soldered to the grounding pad of the printed circuit board, wherein a tab is formed on the body portion of the grounding member and inserted into a hole located in a rear portion the metallic shell.

2. The cable assembly as recited in claim 1, wherein the leg portion clips the grounding pad of the printed circuit board and is soldered thereon.

3. The cable assembly as recited in claim 1, wherein the insulated housing has a pair of arms extending rearward from back surface thereof.

4. The cable assembly as recited in claim 3, wherein each arm has a groove receiving a lateral side of the front portion of the printed circuit board.

5. The cable assembly as recited in claim 1, wherein tail portions of the contacts extend beyond rear surface of the insulated housing and soldered to conductive traces arranged on the front portion of the printed circuit board.

6. A connector adapted for coupling to a cable via a printed circuit board, said printed circuit board having a front portion connected to the connector and an opposite rear portion for coupling to the cable; a framework including a first retainer enclosing a rear portion of the connector and front portion of the printed circuit board, a second retainer opposite to the first retainer and enclosing a rear portion of the printed circuit board; a metallic shell having a metallic sleeve member enclosing a front section of the framework and metallic cap enclosing a rear section of the framework; and a cover enclosing the metallic shell, wherein a grounding member is soldered to a metallic braiding exposed outside of the cable, contacting a grounding pad of the printed circuit board and the metallic cap simultaneously, wherein the grounding member has a body portion soldered to the metallic braiding portion and a leg portion clips the grounding pad of the printed circuit board, wherein a tab is formed on the body portion of the grounding member and inserted into a hole located in a rear portion the metallic cap.

7. The cable assembly as recited in claim 6, wherein a cutout is defined in the rear portion of the printed circuit board and a number of conductive holes are arranged at lateral sides of the cutout.

8. The cable assembly as recited in claim 7, wherein wires exposed outside of the cable are inserted into the conductive holes of the printed circuit board and soldered therein.

9. The cable assembly as recited in claim 7, wherein the wires are wrapped in the second retainer.

10. The cable assembly as recited in claim 7, wherein a strain relief member is molded over a jacket proximate to the grounding member and partially disposed in the cutout of the printed circuit board.

* * * * *